United States Patent [19]

Janowitz et al.

[11] 3,999,128

[45] Dec. 21, 1976

[54] TIME INTERVAL MEASUREMENT METHOD AND APPARATUS

[75] Inventors: Pedro Max Janowitz, Portland; James William Godwin, Beaverton, both of Oreg.

[73] Assignee: Tektronix, Inc., Beaverton, Oreg.

[22] Filed: Apr. 18, 1975

[21] Appl. No.: 569,418

[52] U.S. Cl. ..... 324/181; 324/78 E; 324/78 J; 324/185

[51] Int. Cl.[2] ..... G04F 8/00

[58] Field of Search ..... 324/180, 181, 185, 78 E, 324/78 J, 99 D

[56] References Cited

UNITED STATES PATENTS

| | | | |
|---|---|---|---|
| 2,874,352 | 2/1959 | Durbin | 324/185 |
| 3,553,597 | 1/1971 | Bugay | 324/78 E |
| 3,619,574 | 11/1971 | Mindheim | 324/99 D |
| 3,675,643 | 7/1972 | Funfstuck | 324/78 J |
| 3,781,677 | 12/1973 | Hagen | 324/78 E |

*Primary Examiner*—Robert Segal
*Assistant Examiner*—Michael J. Tokar
*Attorney, Agent, or Firm*—George T. Noe

[57] ABSTRACT

A method and apparatus is disclosed for providing accurate time interval measurements in an oscilloscope. A first voltage which is proportional to the time position of a first selected point along a linear time-base sweep is stored and applied to a subtractor circuit. A second voltage proportional to the time position of a second selected point along the sweep is applied to the subtractor, and the difference between the first and second voltages is obtained. This difference, which is proportional to the time interval between the first and second selected points, is applied to a digital voltmeter calibrated to provide a display in time units.

11 Claims, 3 Drawing Figures

TIME INTERVAL MEASUREMENT METHOD AND APPARATUS

BACKGROUND OF THE INVENTION

As a basic measurement tool, the oscilloscope generally has a grid or graticule superimposed on the display screen which is divided into one-centimeter or one-half-inch divisions. The horizontal sweeping of the cathode-ray tube beam is generally calibrated to the graticule so that sweep rates of time units per graticule division may be established. Differential time measurements between two points of interest were made within the accuracy of human judgment using the graticule scale, or a ruler could be used to measure between the points of interest if a greater accuracy was desired.

In oscilloscopes having delaying and delayed sweep capability, the Delay Time Multiplier control can be utilized to provide differential time measurements. This control is typically a linear 10-turn potentiometer having a mechanical arrangement of dials thereon to provide a reading of the time position of a point on the sweep.

One scheme that was devised to simplify time interval measurements was the two-dot system disclosed in U.S. Pat. application Ser. No. 371,220 filed June 18, 1973. This system included two controls, one for moving both dots along the sweep, and the other for controlling the separation between the dots. The separation, or time interval, between the dots was read out on the mechanical dial described above.

The first scheme to provide an electrical readout of the time interval was that disclosed in U.S. Pat. application Ser. No. 532,089 filed Dec. 12, 1974, wherein two delay pickoff comparators were employed to facilitate a dual delayed sweep. A voltage proportional to the difference between the two preselected comparator levels was applied to a digital voltmeter scaled to provide a time reading.

SUMMARY OF THE INVENTION

According to the present invention, time interval measurements are made by storing a voltage proportional to a first time position and subtracting the stored voltage from a voltage proportional to a second time position.

A voltage which is proportional to the magnitude of the sweep sawtooth is applied across a potentiometer so that the wiper arm thereof may be set to provide a voltage proportional to any time position between the sweep start and termination. The voltages that are selected are applied simultaneously to a sample and hold circuit and to a subtractor circuit. The output of the subtractor circuit is applied to a digital voltmeter and numerically displayed in units of time.

When the first voltage corresponding to the start of a time interval being measured is selected, a switch is momentarily closed, storing the voltage value in the sample and hold circuit. Since the voltage applied from the sample and hold circuit to the subtractor circuit is at this time equal to the voltage applied from the potentiometer to the subtractor, the output of the subtractor is zero, and consequently, the digital voltmeter displays zero.

Subsequent adjustment of the potentiometer varies the voltage applied directly therefrom to the subtractor, while the initial value is stored in the sample and hold circuit. The subtractor circuit then provides an output proportional to the voltage difference between the first selected point and subsequently selected points.

The present invention may be utilized in the delayed sweep circuit of an oscilloscope having delayed sweep capability, wherein the voltage selected by the potentiometer is also applied to one side of the conventional pickoff comparator while the main sweep sawtooth voltage is applied to the other input. Used in this manner, conventional delayed sweep techniques may be utilized to select the time interval start and stop points directly from the delayed sweep display.

The present invention may also be utilized in an oscilloscope having only a single sweep generator wherein the potentiometer voltage and sweep voltage are applied to a comparator as for delayed sweep triggering; however, the comparator output may be differentiated and applied to the z-axis circuitry to produce an intensified dot on the display which may be positioned anywhere on the sweep by adjusting the potentiometer.

Both analog and digital circuit components are available to construct a circuit according to the present invention, each having its own inherent advantages and disadvantages, which will become apparent in the detailed description.

It is therefore one object of the present invention to provide an improved method of measuring time intervals.

It is another object of the present invention to provide a time interval measurement system which can be utilized in an oscilloscope having either normal sweep capability or delaying-delayed sweep capability.

It is a further object of the present invention to provide a time interval measurement system which can be added to an existing oscilloscope as a modification.

It is an additional object of the present invention to provide a direct readout of time difference between two selectable points on a time-base display.

It is yet another object of the present invention to provide a more accurate time interval measurement system.

Other objects and attainments of the present invention will become apparent to those skilled in the art upon a reading of the following detailed description when taken in conjunction with the drawings in which there is shown and described a block diagram and illustrative embodiments of the invention. It is to be understood, however, that these embodiments are not intended to be exhaustive nor limiting of the invention but are given for purposes of illustration in order that others skilled in the art may fully understand the invention and principles thereof and the manner of applying it in practical use so that they modify it in various forms, each as may best be suited to the conditions of the particular use.

DRAWINGS

DETAILED DESCRIPTION

Figure 1:
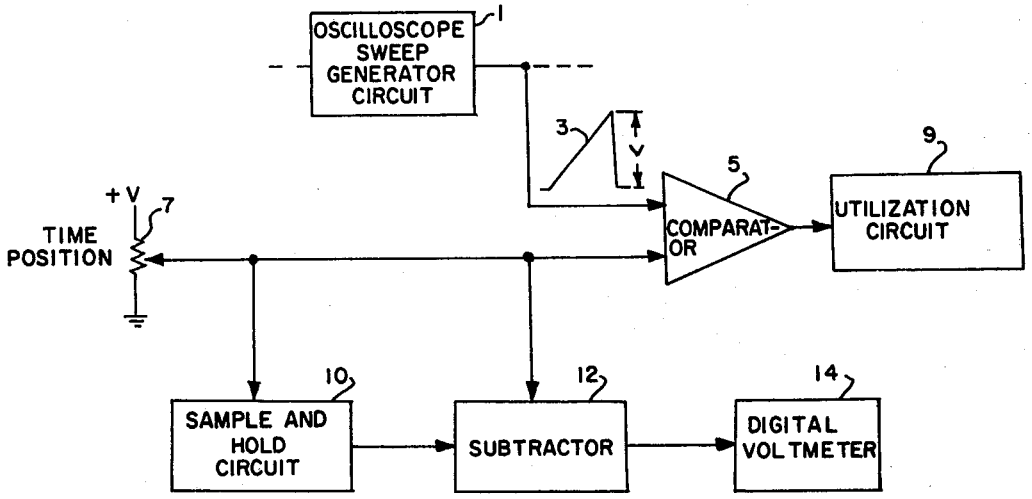
FIG. 1 is a block diagram of a time interval measurement system according to the present invention.

Turning now to the drawings, FIG. 1 shows a block diagram of time interval measurement system according to the present invention. The system is principally intended for use in an oscilloscope; however, the majority of the oscilloscope circuits are not shown because the present invention pertains only to the time-base portion. A conventional sweep generator 1 is shown with interconnections to other oscilloscope circuits shown by phantom lines. The sweep output voltage indicated by sawtooth waveform 3 is utilized to facilitate time interval measurements because its voltage rise is linear with respect to time and hence the voltage at any position thereon is directly proportional to the time position of the cathode-ray tube beam. Sawtooth waveform 3, shown having an overall height V, is applied to one side of a voltage comparator 5.

A time position potentiometer 7, having a voltage thereacross which is proportional to the overall sawtooth voltage magnitude V, provides a selectable voltage at the wiper arm thereof which is applied to the other input of comparator 5. When the sweep sawtooth rises to the voltage set by potentiometer 7, the output of comparator 5 switches, producing an output step function voltage which is applied to utilization circuit 9. Utilization circuit 9 may suitably be a delayed sweep generator which is triggered by the voltage step. Delayed sweep generators are conventional and well known in the art. Utilization circuit 9 may also suitably be a differentiating network to produce a voltage spike coincident with the time position selected, the voltage spike being applied to the oscilloscope z-axis circuit to momentarily increase cathode-ray tube beam current, thereby producing an intensified dot on the waveform display at the time position selected by potentiometer 7. For simplicity, the voltage across potentiometer 7 is shown as being equal to the sweep magnitude V. Thus it can be easily discerned that the voltage selected by the wiper arm of potentiometer 7 is directly proportional to the time position of the oscilloscope display.

The voltage selected by potentiometer is also applied to a sample and hold circuit 10 and to a subtractor 12. The subtractor 12 produces an output voltage which is proportional to the difference between the voltage selected by potentiometer 7 and the voltage stored by the sample and hold circuit 10. The output voltage is applied to an appropriately-scaled digital voltmeter whose display is calibrated in units of time rather than volts. Scaling for the digital voltmeter may be selected in conjunction with the timing or sweep rate switch of the sweep generator circuit 1 so that the voltmeter range is always related to the sweep rate.

A time interval measurement may be made as follows:

Using the time position potentiometer 7, the beginning of the time interval to be measured is selected. This is done by positioning the delayed sweep until the time point is coincident with a reference graticule line, or by positioning the intensified trace segment or dot to the desired point on the normal sweep display.

When the desired time position is selected, the sample and hold circuit is activated to store the voltage which is proportional to the time position. The sample and hold circuit may be activated by closing a momentary contact switch. At this point, the voltages applied to the subtractor 12 from the potentiometer 7 and the sample and hold circuit 10 are equal, consequently the digital voltmeter display is set to zero.

The time position potentiometer 7 is adjusted to select the end point of the time interval being measured. At this point, the sample and hold circuit output voltage remains fixed at the first voltage selected; however, the voltage applied to subtractor 12 from the potentiometer 7 is directly proportional to the second time position. The subtractor 12 produces an output voltage equal to the difference between the two inputs thereof and proportional to the time difference between the time-interval start and stop points. The digital voltmeter 14 displays the numerical value of the time interval in the appropriately-scaled time units.

Figure 2:
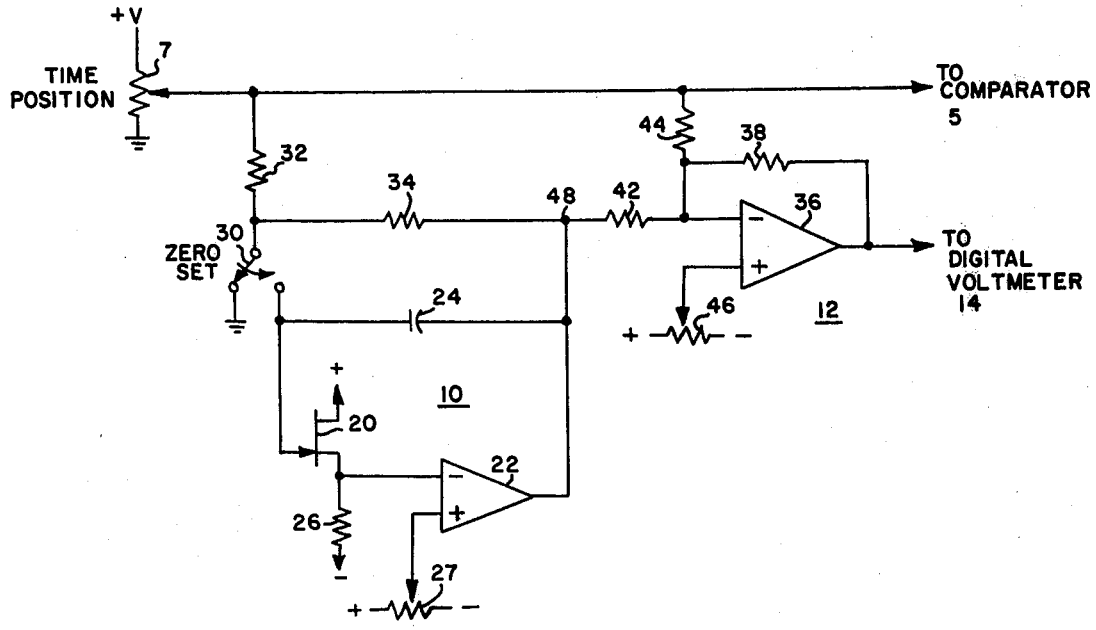
FIG. 2 is a schematic of one embodiment of the present invention utilizing analog circuits.

FIG. 2 shows a schematic diagram of an analog-circuit implementation of the present invention. The time position potentiometer 7 is the same as described hereinabove, and comparator 5 and digital voltmeter 14 have been discussed previously and are omitted from FIG. 2 in the interest of simplicity.

Sample-and-hold circuit 10 is shown as an integrating amplifier comprising a field-effect transistor (FET) source follower 20 and an integrated circuit operational amplifier 22 as the active elements, and feedback capacitor 24 as the storage element. Operational amplifier 22 may suitably be a commercially available 741 type. Resistor 26 provides the source load for FET 20, and potentiometer 27 permits the input balance of operational amplifier 22 to be adjusted, and to establish a virtual ground at the gate of FET 20. A momentary-contact switch 30 connects the input of sample-and-hold circuit 10 to the time-position potentiometer circuit through a resistor 32, and connects a resistor 34 in parallel with capacitor 24. Overall circuit operation will be described in the second paragraph following.

Subtractor circuit 12 comprises an operational amplifier 36, a feedback resistor 38, and two input resistors 42 and 44. Operational amplifier 36 may also be a commercially available 741 type. These amplifiers typically have a pair of inputs marked with negative and positive polarity symbols to indicate inversion and non-inversion respectively of signals applied to those inputs. Potentiometer 46 is connected to the positive input of amplifier 36 to permit adjustment of the input balance thereof, and to establish a virtual ground at the negative input thereof.

The circuit of FIG. 2 operates as follows: Time position potentiometer 7 is adjusted as previously described to establish the start of a time interval to be measured. A voltage proportional thereto is applied to resistors 32 and 44. In this example, resistors 32, 34, 42, and 44 are of equal values to facilitate explanation thereof; however, any ratio can be established as long as the end result is the same. Zero set switch 30 is momentarily disconnected from ground and connected to the gate of FET 20. Through operational amplifier action, the gate of FET 20 remains at virtual ground, and the voltage drop across resistor 34 equals the voltage drop across resistor 32 so that junction 48 is of the same voltage magnitude, but opposite in polarity, as the voltage at the wiper arm of potentiometer 7. Capacitor 24 charges to the voltage across resistor 34. Similarly, it can be seen that the voltage drops across resistors 42 and 44 are the same as the drops across resistors 34 and 32 respectively, so that the net input of current at the negative input of operational amplifier 36 is zero. Consequently, no signal current flows through resistor 38, and the input to digital voltmeter 14 is zero. Thus a zero display is effected for the start of the time interval. When the zero set switch is released, the junction of resistors 32 and 34 is connected to ground; however, the voltage at junction 48 remains at the stored value established by capacitor 24.

When the time position potentiometer 7 is adjusted to locate the end point of the time interval being measured, the voltage corresponding thereto is applied to resistor 44 while junction 48 is at the stored voltage. These voltages are algebraically summed, and a resultant current flows through resistor 38 to produce a voltage thereacross which is applied to digital voltmeter 14. Since the resultant voltage is proportional to the difference between the first and second selected voltages, it is proportional to the time interval being measured and is read out in time units.

Utilizing a numerical example in summary, suppose that initially the voltage at the wiper arm of potentiometer 7 corresponding to the start of a time interval is +1 volt. The zero set switch 30 is connected to the gate of FET 20, causing junction 48 to move to −1 volt. These two voltages are summed at the negative input of amplifier 36, and since their sum is zero, the output of amplifier 36 is zero. The zero set switch 30 is then moved to ground, and the −1 volt is held at junction 48. Then suppose potentiometer 7 is adjusted to provide +2 volts at the wiper arm thereof. The +2 volts is algebraically summed with the −1 volt at junction 48 to produce an output current through resistor 38 to produce a voltage thereacross which is proportional to 1 volt, the difference between the two voltages being summed, and also proportional to the time interval being measured.

Figure 3:
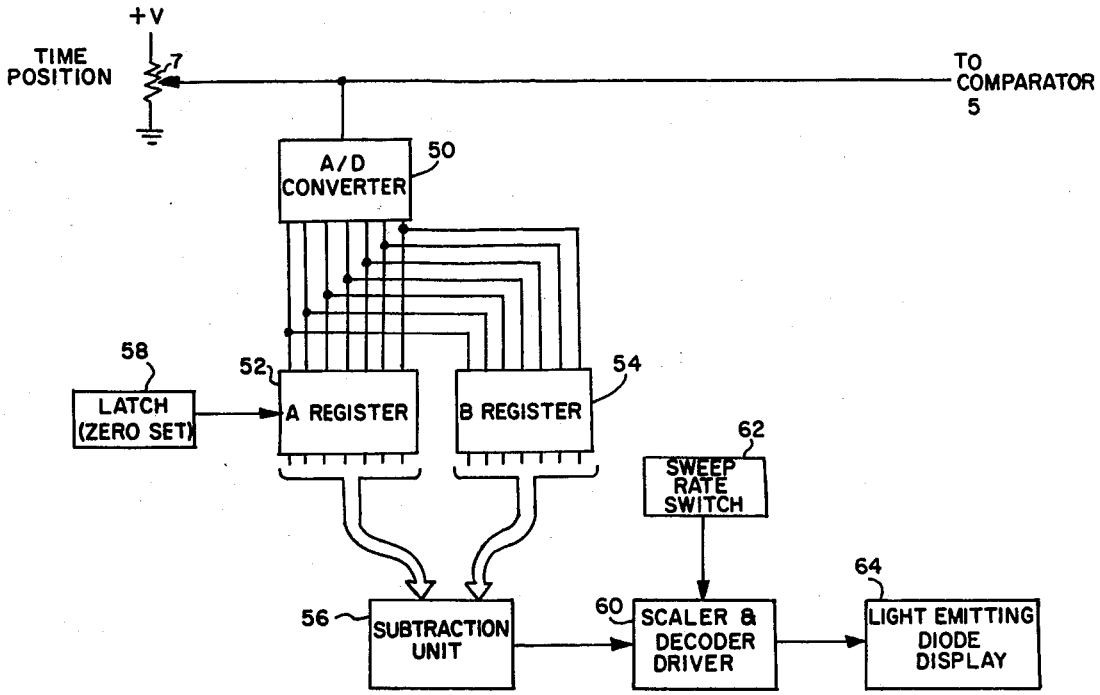
FIG. 3 is a schematic of a second embodiment of the present invention utilizing digital circuits.

FIG. 3 shows a schematic of a digital implementation of the present invention. Time position potentiometer 7 is the same as discussed previously, and again comparator 5 is omitted from the drawing in the interest of simplicity. Analog-to-digital converter 50 receives the voltage from the wiper arm of potentiometer 7 and converts it to a suitable digital value which is applied simultaneously to 'A' register 52 and 'B' register 54. The outputs of these registers are applied to subtraction unit 56, which in turn provides an output proportional to the difference between the two sets of input signals. It can be seen, then, that when the outputs of 'A' register 52 and 'B' register 54 are the same, the output of subtraction unit 56 is zero.

A latching circuit 58 is connected to the 'A' register 52 so that the contents thereof may be selectably stored when a desired voltage is selected by the potentiometer 7, for example, at the start of a time interval to be measured. The latching circuit may suitably be a momentary contact switch and a differentiating network to generate a latching pulse to be applied to register 52. For subsequent adjustment of potentiometer 7, the contents of 'A' register 52 are held at the stored value while the contents of 'B' register 54 track with the output of A–D converter 50.

Subtraction unit 56 may be an arithmetic logic unit employing binary subtraction as described by R. K. Richards in his book, "Digital Design," published by Wiley-Interscience, 1971, or it may be a TTL arithmetic element as described in the book "Designing with TTL Integrated Circuits," published by McGraw-Hill for Texas Instruments Inc., 1971. It should be noted that if subtraction unit 56 is capable of directly receiving the A–D converter output, 'B' register 54 would not be required.

The output of subtraction unit 56 is applied to a scaler and decoder-driver circuit 60 where the difference voltage is appropriately scaled and decoded. The associated time-base sweep rate switch 62 may provide scaling information as mentioned previously to establish the voltmeter range. A display unit 64, which may consist of light-emitting diodes arranged to form alphanumeric characters, displays the resulting numerical value of the difference voltage in the appropriately scaled units of time.

While the analog circuit embodiment shown in FIG. 2 has a disadvantage in that the voltage held by the sample-and-hold circuit may change with time due to inherent leakages of the capacitor and field effect transistor, the digital circuit embodiment shown in FIG. 3 is costlier to implement.

While there has been shown and described the preferred embodiments of the present invention, it will be apparent to those skilled in the art that many changes and modifications may be made without departing therefrom in its broader aspects; therefore, the appended claims are intended to cover all such changes and modifications as fall within the true spirit and scope of this invention.

What we claim as being novel is:

1. A method for measuring selectable time intervals along a linear ramp time-base waveform, comprising the steps of:
   - selecting a first voltage which is proportional to the time position of a first selected point along said time-base waveform;
   - storing said first voltage in a memory device;
   - selecting a second voltage which is proportional to the time position of a second selected point along said time-base waveform;
   - subtracting said first voltage from said second voltage in an arithmetic device to produce a difference voltage proportional to the time difference between said selected points; and
   - applying said difference voltage to a digital voltmeter adapted to provide a numerical readout in time units.

2. An apparatus for measuring selectable time intervals along a linear ramp time-base waveform, comprising:
   - means for selecting first and second voltages which are proportional to first and second selected points along the time axis of said time-base waveform;
   - memory means for storing said first voltage;
   - means for subtracting said first voltage from said second voltage so that a difference voltage proportional to said time interval is produced; and
   - digital voltmeter means for receiving said difference voltage and providing a readout thereof.

3. The apparatus according to claim 2 wherein said means for selecting first and second voltages comprises a potentiometer having a voltage thereacross proportional to the voltage magnitude of said time-base waveform.

4. The apparatus according to claim 3 further including a voltage comparator receiving said time-base waveform at one input thereof and said selected voltage at a second input thereof, and a utilization circuit connected to receive the output of said comparator to facilitate visually locating said selected points along said time axis.

5. The apparatus according to claim 3 wherein said subtraction means is coupled to said memory means and to said potentiometer to receive inputs therefrom so that said voltage difference produced is proportional to the voltage stored in said memory means and the voltage selected by said potentiometer.

6. An apparatus for measuring selectable time intervals along a linear ramp time-base waveform, comprising:

selection means for selecting points along the time axis of said time-base waveform and generating voltage values proportional thereto;

memory means for selectively storing said generated voltage values;

subtraction means for receiving said stored voltage values and said generated voltage values and producing a difference voltage value therefrom, whereby said voltage value difference is proportional to the time interval between selected points; and digital voltmeter means for receiving said difference voltage value and providing a readout thereof in time units.

7. The apparatus according to claim 6 wherein said selection means comprises a voltage comparator having a potentiometer connected to one input thereof and said time-base waveform applied to the other input thereof, said potentiometer having a voltage thereacross proportional to the voltage magnitude of said time-base waveform so that voltage produced at the wiper arm thereof is proportional to said selected time point.

8. A time interval measurement system in an oscilloscope, comprising:

at least one sweep generator for generating time-base sweep waveforms;

time position selection means for selecting points along the time axis of said time-base waveforms and generating voltages proportional thereto;

memory means for selectively storing values of said generated voltages;

subtraction means for receiving voltage values from said time position selection means and said memory means and producing the arithmetic difference between said values; and voltmeter means for receiving said difference and providing an indication thereof in time units, said difference being proportional to the time interval between said selected points.

9. The system according to claim 8 wherein said time position selection means comprises a potentiometer having a voltage thereacross proportional to the voltage magnitude of said time-base waveform, and a comparator for comparing said time-base waveform to voltage from the wiper arm of said potentiometer and generating a signal at the coincidence thereof.

10. The system according to claim 9 further including a utilization circuit connected to receive said coincidence signal from said comparator to provide an indication in the oscilloscope display of the time position selected in response thereto.

11. The system according to claim 8 wherein said voltmeter means is scaled in accordance with the sweep rate of said time-base waveforms.

* * * * *

UNITED STATES PATENT AND TRADEMARK OFFICE

CERTIFICATE OF CORRECTION

PATENT NO. : 3,999,128

DATED : December 21, 1976

INVENTOR(S) : PEDRO M. JANOWITZ et al

It is certified that error appears in the above-identified patent and that said Letters Patent are hereby corrected as shown below:

Column 1, Line 32, "electrical" should be --electronic--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*